US009638407B2

(12) United States Patent
Winters

(10) Patent No.: US 9,638,407 B2
(45) Date of Patent: May 2, 2017

(54) ELEVATED LIGHT SOURCE CAVITY

(71) Applicant: Philip Dean Winters, Senoia, GA (US)

(72) Inventor: Philip Dean Winters, Senoia, GA (US)

(73) Assignee: Cooper Technologies Company, Houston, TX (US)

( * ) Notice: Subject to any disclaimer, the term of this patent is extended or adjusted under 35 U.S.C. 154(b) by 51 days.

(21) Appl. No.: 14/470,800

(22) Filed: Aug. 27, 2014

(65) Prior Publication Data

US 2015/0062910 A1 Mar. 5, 2015

Related U.S. Application Data

(60) Provisional application No. 61/870,669, filed on Aug. 27, 2013.

(51) Int. Cl.

| | |
|---|---|
| ***F21V 29/70*** | (2015.01) |
| ***F21V 15/01*** | (2006.01) |
| *F21W 131/10* | (2006.01) |
| *F21Y 101/00* | (2016.01) |

(52) U.S. Cl.

CPC ..... *F21V 29/70* (2015.01); *F21V 15/01* (2013.01); *F21W 2131/10* (2013.01); *F21Y 2101/00* (2013.01)

(58) Field of Classification Search

CPC ... F21S 6/06; F21S 6/006; F21S 8/036; F21V 29/70

See application file for complete search history.

(56) References Cited

U.S. PATENT DOCUMENTS

| | | | | |
|---|---|---|---|---|
| 7,789,528 | B2 | 9/2010 | Mo et al. | |
| 9,212,812 | B2 | 12/2015 | Kinnune | |
| 2011/0222284 | A1* | 9/2011 | Kong | F21S 8/086 362/249.02 |
| 2011/0235335 | A1 | 9/2011 | Ishida | |
| 2012/0147608 | A1* | 6/2012 | Kawagoe | F21V 5/007 362/294 |
| 2012/0275162 | A1 | 11/2012 | Spiro | |
| 2014/0177226 | A1* | 6/2014 | Goelz | F21V 29/2212 362/294 |

FOREIGN PATENT DOCUMENTS

| | | |
|---|---|---|
| KR | 1020110138485 | 12/2011 |
| RU | 106335 | 7/2011 |
| RU | 111254 | 12/2011 |
| RU | 2470222 | 12/2012 |

OTHER PUBLICATIONS

International Search Report, mailed Nov. 13, 2014, for PCT/US2014/052996.

Office Action mailed May 12, 2016 for U.S. Appl. No. 14/470,824.

* cited by examiner

*Primary Examiner* — Bao Q Truong
*Assistant Examiner* — Nathaniel Lee
(74) *Attorney, Agent, or Firm* — King & Spalding LLP

(57) ABSTRACT

A heat sink for an outdoor lighting fixture includes a top portion and a skirt portion. The skirt portion extends down from an outer perimeter of the top portion. The top portion includes an elevated portion and a transition portion surrounding the elevated portion. The elevated portion and the transition portion define a cavity. The top portion further includes a planar portion surrounding the transition portion. The elevated portion is elevated above the planar portion.

20 Claims, 6 Drawing Sheets

ELEVATED LIGHT SOURCE CAVITY

RELATED APPLICATIONS

The present application claims priority to under 35 U.S.C. §119(e) and incorporates herein by reference U.S. Provisional Patent Application No. 61/870,669, titled "Elevated Light Source Cavity," and having a filing date of Aug. 27, 2013.

TECHNICAL FIELD

The present disclosure relates generally to outdoor lighting solutions, and more particularly to an elevated cavity for one or more light sources of an outdoor lighting fixture.

BACKGROUND

Outdoor lighting fixtures are typically exposed to different weather conditions such as rain. Electrical components of such lighting fixtures need to be protected from rain and snow that may damage them. For example, water may cause an electrical short circuit which can damage the components due to excessive current flow. Further, water may cause rusting of electrical connections and exposed wires, which may result in unreliable operation as well as shortened life span of the components of a lighting fixture and the lighting fixture itself.

Thus, an outdoor lighting structure that cost-effectively reduces risk of damage to the lighting fixture and its components is desirable.

SUMMARY

In general, the present disclosure relates to outdoor lighting solutions, and more particularly to an elevated cavity for one or more light sources of an outdoor lighting fixture. In an example embodiment, a heat sink for an outdoor lighting fixture includes a top portion and a skirt portion. The skirt portion extends down from an outer perimeter of the top portion. The top portion includes an elevated portion and a transition portion surrounding the elevated portion. The elevated portion and the transition portion define a cavity. The top portion further includes a planar portion surrounding the transition portion. The elevated portion is elevated above the planar portion.

In another example embodiment, an outdoor lighting structure includes a housing and a heat sink attached to the housing. The heat sink includes a top portion and a skirt portion extending down from the top portion. The heat sink is disposed below the housing. The top portion includes an elevated portion and a transition portion surrounding the elevated portion. The elevated portion and the transition portion define a cavity. The top portion further includes a planar portion surrounding the transition portion. The elevated portion is elevated above the planar portion.

In another example embodiment, an outdoor lighting fixture includes a housing and a heat sink attached to the housing. The heat sink includes a top portion and a skirt portion extending down from the top portion. The heat sink is disposed below the housing. The top portion includes an elevated portion and a transition portion surrounding the elevated portion. The elevated portion and the transition portion define a cavity. The top portion further includes a planar portion surrounding the transition portion. The elevated portion is elevated above the planar portion. Further, the outdoor lighting fixture includes a light source attached to the elevated portion and positioned within the cavity. The outdoor lighting fixture also includes a driver positioned in the housing to provide power to the light source.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
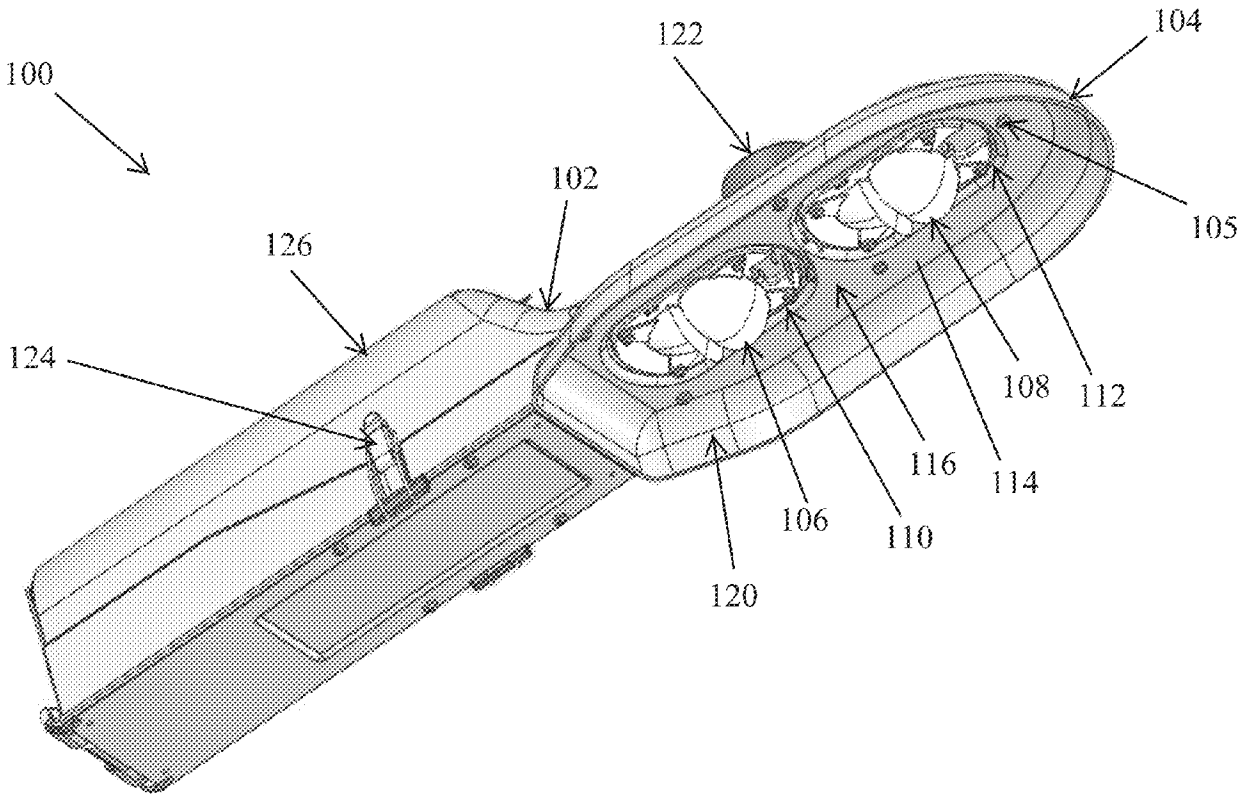
FIG. 1 illustrates a perspective view of an outdoor lighting structure according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Turning now to the figures, particular embodiments are described. FIG. 1 illustrates a perspective view of a lighting structure according to an example embodiment. The lighting structure 100 includes a housing 102 and a heat sink 104. For example, the heat sink 104 may be attached to the housing 102, for example, by one or more fasteners. The lighting structure 100 also includes a first lens 106 and a second lens 108. The first lens 106 and the second lens 108 are attached to the heat sink 104. The lens 106 is attached to the heat sink 104 such that one or more light sources (e.g., one or more light emitting diodes (LEDs)) are covered by the lens 106. Similarly, the lens 108 is attached to the heat sink 104 such that one or more light sources (e.g., one or more LEDs) are covered by the lens 108. To illustrate, one or more LEDs may be attached to an elevated portion of the heat sink 104 that is covered by the lens 106, and one or more other LEDs may be attached to another elevated portion of the heat sink 104 that is covered by the lens 108.

In some example embodiments, the lighting structure 100 also includes a sensor 122 and a latch 124 located at a compartment section 126 of the housing 102. For example, the sensor 122 may be positioned on the housing 102 substantially above the heat sink 104. To illustrate, the sensor 122 may be a light sensor that senses the amount of light near the lighting structure 100 and that generates a corresponding indicator or electrical signal. To illustrate, the light sources of the lighting structure 100 may be turned on or off based on the indicator or electrical signal from the sensor 122. In some example embodiments, the latch 124 may be used to hold upper and lower portions of the housing 102 and may be unlatched to gain access to a compartment of the housing 102. In some alternative embodiments, the latch 124 may be omitted or may be replaced by another structure(s) that performs the same or similar function.

In some example embodiments, the heat sink 104 includes a top portion 114 and a skirt portion 120. The top portion 114 of the heat sink 104 includes two elevated portions (described below in more detail), transition portions 110, 112, and a planar portion 116. The transition portions 110, 112 extend from the planar portion 116 of the top portion 114 toward the respective one of the elevated portions. Each one of the elevated portions has an outer perimeter that is surrounded by a respective one of the transition portions 110, 112. The elevated portion is elevated above the planar portion 116. To illustrate, each elevated portion and the respective transition portion 110, 112 define a respective elevated cavity as described below in more detail. In some example embodiments, the first lens 106 is attached to one of the elevated portions such that an outer edge of the lens 106 is surrounded by the transition portion 110 within the respective elevated cavity. Similarly, the first lens 108 may be attached to the other one of the elevated portions such that an outer edge of the lens 108 is surrounded by the transition portion 112 within the respective elevated cavity.

In some example embodiments, the planar portion 116 of the top portion 114 may include a section that is between the two elevated portions, such that the transition portion 110 and transition portion 112 are not abutted against each other.

In some example embodiments, the skirt portion 120 extends down from the top portion 114 of the heat sink 104. For example, the skirt portion 120 may extend down around an outer perimeter of the entire top portion 114 of the heat sink 104 as illustrated in FIG. 1. To illustrate, the skirt portion 120 may curve down from the planar portion 114. In some alternative embodiments, skirt portion 120 may extend down from only some sections of the top portion 114. For example, the skirt portion 120 may have a substantially U-shaped outer perimeter such that a section of the skirt 120 closer to the compartment section 126 of the housing 102 is omitted. In some example embodiments, the skirt portion 120 may extend down from the top portion 114 less or more than shown in FIG. 1.

In some example embodiments, the heat sink 104 may be made from a material, such as a metal (e.g., aluminum), that effectively dissipates heat from the light sources and other circuitry/components of the lighting structure 100. The housing 102 may also be made from a material, such as aluminum. The lenses 106, 108 may be made from a transparent plastic or other suitable material known to those of ordinary skill in the art with the benefit of the current disclosure.

Because the elevated portions are elevated above the planar portion 116 of the top portion 114 and are covered by the housing 102, risk of water, such as rain water, reaching light sources and other electrical components that are attached to the elevated portions on an underside of the heat sink 104 is reduced.

Although the lighting structure 100 is shown in FIG. 1 as having the two lenses 106, 108, in alternative embodiments, the lighting structure 100 may have one lens or more than two lenses without departing from the scope of this disclosure. Further, in some example embodiments, the planar portion 116 may be entirely planar, substantially planar, and/or may include a non-planar portion without departing from the scope of this disclosure. In some alternative embodiments, the housing 102 and the heat sink 104 may have other shapes other than shown in FIG. 1 without departing from the scope of this disclosure.

Figure 2:
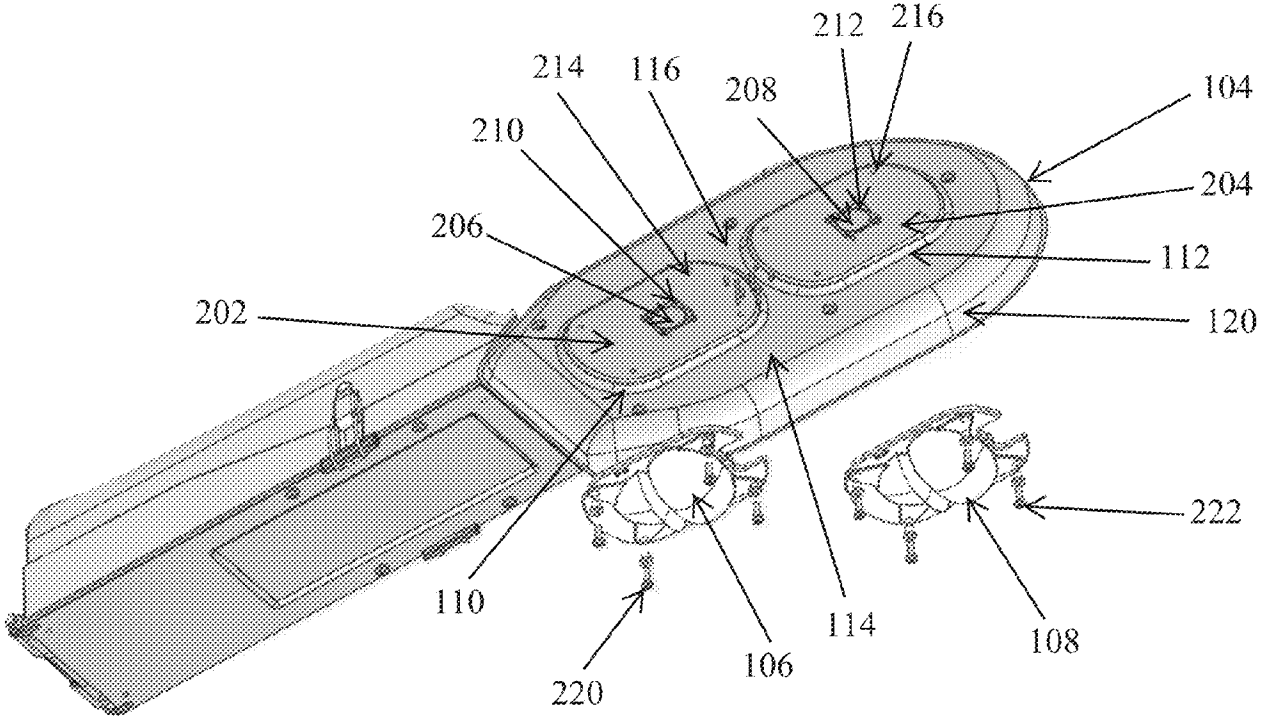
FIG. 2 illustrates a partially-exploded view of the lighting structure of FIG. 1 according to an example embodiment.

FIG. 2 illustrates a partially-exploded view of the lighting structure 100 of FIG. 1 according to an example embodiment. As illustrated in FIG. 2, the heat sink 104 includes the top portion 114 and the skirt portion 120 extending down from the top portion 114. The top portion 114 includes a first elevated portion 202 and a second elevated portion 204. As illustrated in FIG. 2, a light source 206 is attached to the first elevated portion 202, and another light source 208 is attached to the second elevated portion 204. In some example embodiments, the light sources 206, 208 are LEDs. For example, one or more LEDs may be attached to a printed circuit board (PCB) that is attached to the first elevated portion 202. Similarly, one or more LEDs may be attached to another printed circuit board (PCB) that is attached to the second elevated portion 204. To illustrate, a printed circuit board with the light source 206 may be attached to the first elevated portion 202 by one or more fasteners (e.g., screws), and another printed circuit board with the light source 208 may be attached to the second elevated portion 204 by one or more fasteners.

In some example embodiments, the first elevated portion 202 includes one or more wire holes 210 that may be used to extend electrical wires from a power source (e.g., a driver such as an LED driver) to the light source 206. For example, one or more wires may be extended through the wire holes 210 from a driver positioned in the housing 102. Similarly, the second elevated portion 204 may include one or more wire holes 212 that may be used to extend wires from a power source to the light source 208.

In some example embodiments, the first elevated portion 202 includes one or more fastener holes 214. The fastener holes 214 may be used to attach the lens 106 to the heat sink 104 such that the lens 106 covers the light source 206 on the underside of the heat sink 104. For example, one or more fasteners 220 may be extended through the fastener holes 214 to attach the lens 106 to the first elevated portion 202 of the top portion 114 of the heat sink 104. Alternatively, one or more snaps that are attached to the lens 106 may be inserted through the fastener holes 214 to attach the lens 106 to the first elevated portion 202. Similarly, the second elevated portion 204 includes one or more fastener holes 216. The fastener holes 216 may be used to attach the lens 108 to the heat sink 104 such that the lens 108 covers the light source 208 on the underside of the heat sink 104. For example, one or more fasteners 222 may be extended through the fastener holes 216 to attach the lens 108 to the second elevated portion 204 of the top portion 114 of the heat sink 104. Alternatively, one or more snaps that are attached to the lens 108 may be inserted through the fastener holes 216 to attach the lens 108 to the second elevated portion 204.

As illustrated in FIG. 2, the first elevated portion 202 is surrounded by the first transition portion 110. In particular, the outer perimeter of the first elevated portion 202 is bounded by the first transition portion 110. Similarly, the second elevated portion 204 is surrounded by the second transition portion 112. In particular, the outer perimeter of the second elevated portion 204 is bounded by the first transition portion 112. The first transition portion 110 and the second transition portion 112 are surrounded by the planar portion 116 of the heat sink 104. As illustrated in FIG. 2, the first elevated portion 202 is elevated above the planar portion 116, where the first transition portion 110 extends upward from the planar portion 116 to the first elevated portion 202. The second elevated portion 204 is similarly elevated above the planar portion 116, where the second transition portion 112 extends upward from the planar portion 116 to the second elevated portion 204.

To illustrate, the first elevated portion 202 and the first transition portion 110 define a first cavity on the underside of the heat sink 104. As illustrated in FIG. 2, the first light source 206 is positioned within the first cavity. Similarly, the second elevated portion 204 and the second transition portion 112 define a second cavity on the underside of the heat sink 104. As also illustrated in FIG. 2, the second light source 208 is positioned within the second cavity. In some example embodiments, each one of the elevated portions 202, 204 and the transition portions 110, 112 may have a stadium-like shape that includes a rectangle with semicircles at two opposite ends of the rectangle. In some alternative embodiments, the elevated portions 202, 204 and the transition portions 110, 112 may have other shapes such as a substantially oval shape and a rectangular shape without departing from the scope of this disclosure.

Although two cavities defined by the elevated portions 202, 204 and the transition portions 110, 112 are illustrated in FIG. 2, in alternative embodiments, the lighting structure 100 may include just one elevated cavity or more than two elevated cavities. Further, although the light sources 206, 208 are shown in FIG. 2 as being substantially centrally located in the respective elevated portion 202, 204, in some alternative embodiments, one or both of the light sources 206, 208 may be located substantially off center.

Figure 3:
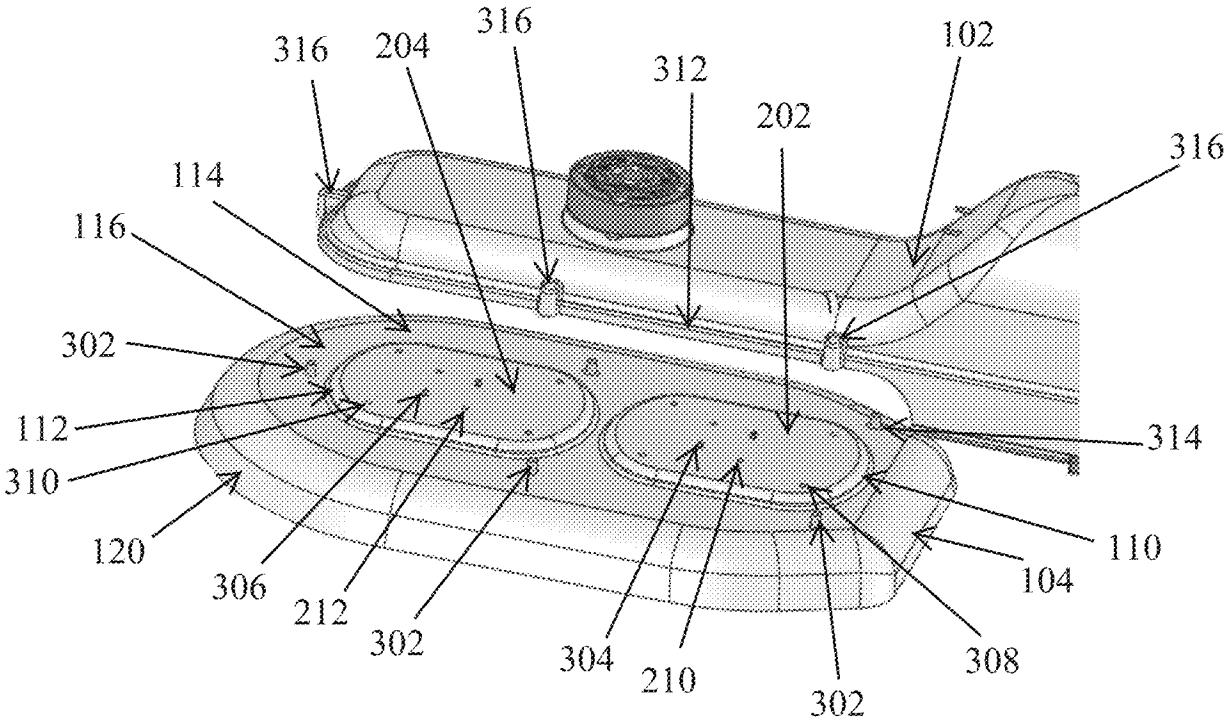
FIG. 3 illustrates another partially-exploded view of the lighting structure of FIG. 1 according to an example embodiment.

FIG. 3 illustrates another partially-exploded view of the lighting structure of FIG. 1 according to an example embodiment. As illustrated in FIG. 3, the heat sink 104 includes the top portion 114 and the skirt portion 120. For example, the top portion 114 includes the planar portion 116, the first elevated portion 202, and the second elevated portion 204. In some example embodiments, fasteners 302 may be used to attach the heat sink 104 to the housing 102. For example, the heat sink 104 may include one or more fastener holes 314, and the housing 102 may include corresponding attachment holes 316. To attach the heat sink 104 to the housing 102, the fasteners 302 may be extended through corresponding fastener holes 314 of the heat sink 104 and may be inserted into the corresponding attachment holes 316 on the housing 102.

To illustrate, the housing 102 may be attached to the heat sink 104 using the fasteners 302 such that the housing 102 fully covers the elevated portions 202, 204 and the transition portions 110, 112 from view. In some example embodiments, the housing 102 may include a ridge 312 that extends around at least a portion of the housing 102 such that the transition portions 110, 112 are enclosed by the housing 102 when the heat sink 104 is attached to the housing 102, for example, using the fasteners 302. In general, the housing 102 is shaped to be positioned on the heat sink 104 such that surfaces of the elevated portions 202, 204 and surfaces of the transition portions 110, 112 on the top side of the heat sink 104 are covered by the housing 102. For example, the attachment of the housing 102 to the heat sink 104 using the fasteners 302 such that the housing 102 covers the elevated portions 202, 204 and the transition portions 110, 112 may reduce the amount of water that may reach a portion of the top portion 114 that is covered by the housing 102.

In some example embodiments, the light sources 206, 208 (shown in FIG. 2) may be attached to the elevated portions 202, 204 using one or more fasteners 304, 306. For example, the one or fasteners (e.g., screw) 304 may be used to attach the light source 206 (e.g., a PCB with one or more LEDs disposed thereon) to the first elevated portion 202. Similarly, the one or fasteners (e.g., screw) 306 may be used to attach the light source 208 (e.g., a PCB with one or more LEDs disposed thereon) to the second elevated portion 202.

As described above, the first elevated portion 202 includes one or more wire holes 210 that may be used to extend electrical wires from a power source to the light source 206. Similarly, the second elevated portion 204 may include one or more wire holes 212 that may be used to extend electrical wires from the same or different power source to the light source 208.

In some example embodiments, the lenses 106, 108 shown in FIGS. 1 and 2 may be attached to the heat sink 104 using one or more fasteners 220, 222 (shown in FIG. 2) that are inserted in corresponding fastener holes 308, 310. For example, the fasteners 220 may be inserted through the fastener holes 308 in the first elevated portion 202 to attach the lens 106 to the first elevated portion 202. Similarly, the fasteners 222 may be inserted through the fastener holes 310 in the second elevated portion 204 to attach the lens 108 to the second elevated portion 204.

As illustrated in FIG. 3, the first elevated portion 202 and the second elevated portion 204 are raised above the planar portion 116 of the heat sink 104. Because the first elevated portion 202 and the second elevated portion 204 are elevated above the planar portion 116, risk of water, such as rain water, reaching the elevated portions 202, 204 is reduced. To illustrate, water that comes in contact with an exposed part of the planar portion 116 would have to enter a part of the planar portion 116 that is covered by the housing 102 and accumulate to a level that exceeds the height of the transition portion 110, 112 in order to reach the respective one of the elevated portion 202, 204. By reducing the risk of water reaching the elevated portions 202, 204, risk of damage (for example, due to short circuit caused by water) to lighting fixtures (e.g., to the light sources 206, 208) is reduced.

In some example embodiments, the elevated portions 202, 204 may be formed in a single piece of a particular material by pressing on a portion of the material to form the elevated portions 202, 204. The skirt 120 may also be formed in the same piece of material using simple methods such as bending and pressing. In some example embodiments, the heat sink 104 may be made using techniques such as die casting.

Figure 4A:
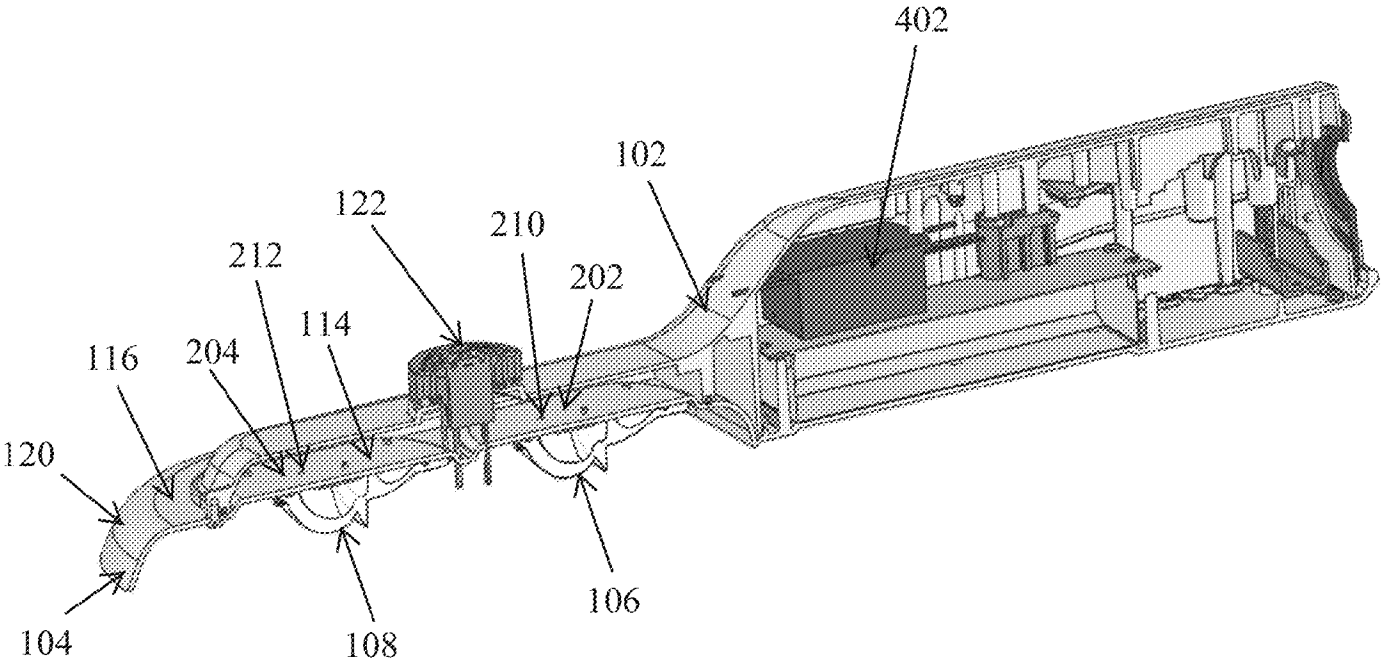
FIGS. 4A and 4B illustrates cross-sectional views of the lighting structure of FIG. 1 according to an example embodiment.
Figure 4B:
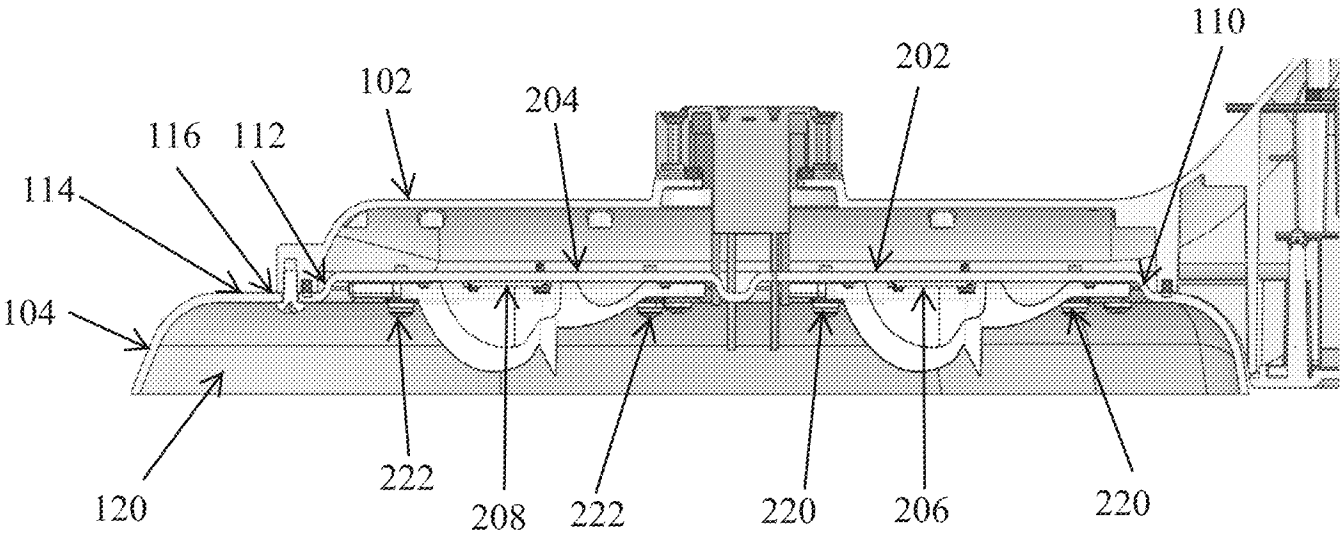

FIGS. 4A and 4B illustrate cross-sectional views of the lighting structure of FIG. 1 according to an example embodiment. Referring to FIGS. 4A and 4B, the light source 206 is attached to the first elevated portion 202 within the cavity defined by the first elevated portion 202 and the transition portion 110. Similarly, the light source 208 is attached to the second elevated portion 204 within the cavity defined by the second elevated portion 204 and the transition portion 112. To illustrate, the light source 206 may emit light toward the lens 106 such that the light passes through the lens 106 to illuminate an area near the lighting structure 100. Similarly, the light source 208 may emit light toward the lens 108 such that the light passes through the lens 108 to illuminate an area near the lighting structure 100.

In some example embodiments, the lighting structure 100 may include a driver 402 (e.g., an LED driver). For example, the driver 402 may be positioned in a compartment within the housing 102. To illustrate, the driver 402 may be designed to provide power to the light sources 206, 208. For example, electrical wires (not shown) may be extended from the driver 402 to the light source 206 through the one or more wire holes 210. Similarly, electrical wires (not shown) may be extended from the driver 402 to the light source 208 through the one or more wire holes 212.

As described above, the lens 106 may be attached to the first elevated portion 202 using the one or more fasteners 220. Similarly, the lens 108 may be attached to the second elevated portion 204 using the one or more fasteners 222. As more clearly illustrated in FIG. 4B, the lens 106 may be attached to the first elevated portion 202 within the cavity defined by the first elevated portion 202 and the transition portion 110. Similarly, the lens 108 may be attached to the second elevated portion 204 within the cavity defined by the second elevated portion 204 and the transition portion 112.

As illustrated in FIGS. 4A and 4B, a portion of the planar portion 116 of the top portion 114 is exposed to view and outside elements (e.g., rain, snow, etc.) and a portion of the planar portion 116 is covered by the housing 102. Further, the elevated portions 202, 204 are raised above the planar portion 116 by the respective heights of the transition portions 110, 112. Thus, water that may enter the portion of the planar portion 116 that is covered by the housing 102 needs to accumulate in excess of the respective heights of the transition portions 110, 112 to reach the elevated portions 202, 204. Accordingly, risk of water reaching the elevated portions 202, 204 and causing damage to the light sources 206, 208 is reduced.

In some alternative embodiments, the lenses 106, 108 may have shapes other than shown in FIGS. 4A and 4B. Further, some example embodiments, the transition portions 110, 112 may be slanted more or less than shown in FIGS. 4A and 4B.

Figure 5:
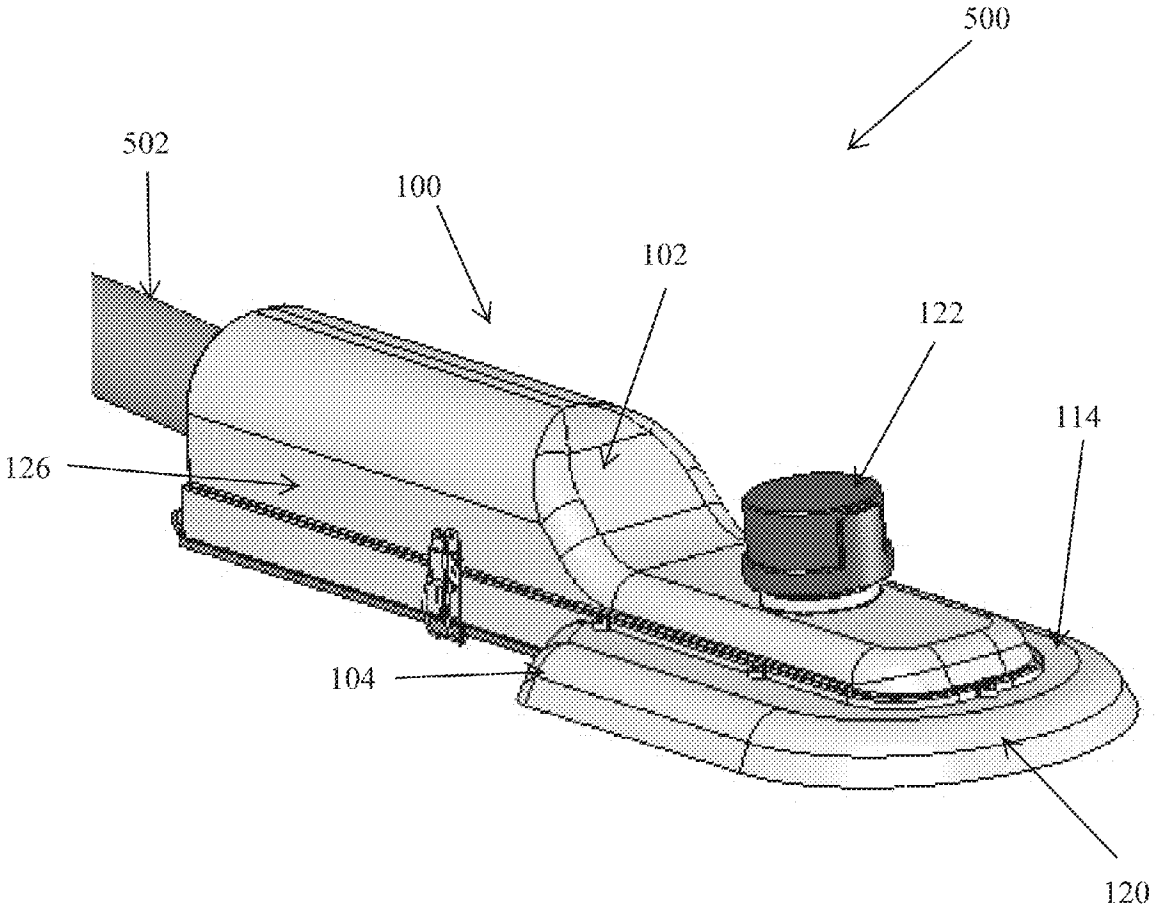
FIG. 5 illustrates a perspective view of an outdoor lighting fixture including the lighting structure of FIG. 1 according to an example embodiment.

FIG. 5 illustrates a perspective view of an outdoor lighting fixture 500 according to an example embodiment. The lighting fixture 500 includes the lighting structure 100 of FIG. 1 and a support beam 502 attached to the lighting structure 100. For example, the support bean 502 may be attached to an end portion the lighting structure 100 distal from the heat sink 104 as illustrated in FIG. 5. Alternatively, the support beam 502 or another similar structure may be attached to the housing 102 at a different location than shown in FIG. 5.

In some example embodiments, the lighting fixture 500 also includes a sensor 122. For example, the sensor 122 may be positioned on the housing 102 substantially above the heat sink 104 as illustrated in FIG. 5. In some example embodiments, the sensor 122 may be a light sensor that senses the amount of light near the lighting fixture 500 and that generates a corresponding indicator or electrical signal for controlling light sources of the lighting fixture 500.

As described above, the lighting structure 100 includes the housing 102 and the heat sink 104. The compartment section 126 of the housing 102 may include a power source (e.g., the driver 402 shown in FIG. 4A) that provides power to the light sources (e.g., the light sources 206, 208 shown in FIG. 3).

As illustrated in FIG. 5, the heat sink 104 includes the top portion 114 and the skirt portion 120. For example, the heat sink 104 is below at least a portion of the housing 102. For example, the heat sink 104 may be attached to the portion of the housing 102 that does not include the driver 402. As illustrated in FIG. 5, the housing 102 and the heat sink 104 are attached to each other such that the elevated portions 202, 204 (shown in FIG. 2) are covered by the housing 102. Further, the housing 102 and the heat sink 104 are attached to each other such that the elevated portions 110, 112 (shown in FIG. 1) are covered by the housing 102. Thus, the housing 102 prevents water, such as rain water, from directly reaching the elevated portions 202, 204. Further, because water that reaches the skirt portion 120 is generally directed away from the top portion 114 of the heat sink 104. Water that sips through between the housing 102 and the heat sink 104 has to reach the height of the elevated portions 202, 204 (shown in FIG. 2) to pose a risk to the light sources 206, 208 (shown in FIG. 2), electrical connections, and other electrical components attached to the elevated portions 202, 204 and disposed on the underside of the heat sink 104. Thus, risk of damage from water to the lighting fixture 500 may be reduced by using the heat sink 104 with the elevated portions 202, 204.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A heat sink for an outdoor lighting fixture, the heat sink comprising:

a top portion; and a skirt portion extending down from an outer perimeter of the top portion, the top portion comprising:

an elevated portion;

a transition portion surrounding the elevated portion, wherein the elevated portion and the transition portion define a cavity; and a planar portion surrounding the transition portion, wherein the elevated portion is elevated above the planar portion, wherein the transition portion is disposed between and is contiguous with the elevated portion and the planar portion, and wherein the planar portion is disposed between and is contiguous with the transition portion and the skirt portion, and wherein the skirt portion extends down from the planar portion;

wherein the transition portion is disposed between and is contiguous with the elevated portion and the planar portion, and wherein the planar portion is disposed between and is contiguous with the transition portion and the skirt portion.

2. The heat sink of claim 1, wherein the top portion further comprises:

a second elevated portion; and a second transition portion surrounding the second elevated portion, wherein the second elevated portion and the second transition portion define a second cavity, wherein the planar portion surrounds the second transition portion, and wherein the second elevated portion is elevated above the planar portion.

3. The heat sink of claim 1, wherein the elevated portion has a stadium-like shape.

4. The heat sink of claim 1, wherein the elevated portion includes a fastener hole for attaching a lens to the elevated portion on an underside of the heat sink.

5. The heat sink of claim 4, wherein the elevated portion includes a second fastener hole for attaching a light source to the elevated portion on the underside of the heat sink.

6. The heat sink of claim 5, wherein the elevated portion includes a wire hole for extending an electrical wire therethrough.

7. The heat sink of claim 1, wherein the top portion includes an attachment hole for attaching the heat sink to a housing from above or below the housing.

8. An outdoor lighting structure, comprising:

a housing; and a heat sink attached to the housing, the heat sink comprising a top portion and a skirt portion extending down from the top portion, wherein the heat sink is disposed below the housing and wherein the top portion comprises:

an elevated portion;

a transition portion surrounding the elevated portion, wherein the elevated portion and the transition portion define a cavity; and a planar portion surrounding the transition portion, wherein the elevated portion is elevated above the planar portion, wherein the transition portion is disposed between and is contiguous with the elevated portion and the planar portion, and wherein the planar portion is disposed between and is contiguous with the transition portion and the skirt portion, and wherein the skirt portion extends down from the planar portion.

9. The outdoor lighting structure of claim 8, further comprising a light source attached to the elevated portion and positioned within the cavity.

10. The outdoor lighting structure of claim 9, further comprising a lens attached to the elevated portion, wherein the lens covers the light source on an underside of the heat sink.

11. The outdoor lighting structure of claim 9, wherein the elevated portion includes a wire hole for extending an electrical wire therethrough from the housing to the light source.

12. The outdoor lighting structure of claim 8, further comprising:

a second elevated portion; and a second transition portion surrounding the second elevated portion, wherein the second elevated portion and the second transition portion define a second cavity, wherein the planar portion surrounds the second transition portion, and wherein the second elevated portion is elevated above the planar portion.

13. The outdoor lighting structure of claim 12, further comprising a light source attached to the second elevated portion and positioned within the second cavity.

14. The outdoor lighting structure of claim 13, further comprising a lens attached to the second elevated portion, wherein the lens covers the light source.

15. The outdoor lighting structure of claim 12, wherein the second elevated portion includes a wire hole for extending an electrical wire therethrough from the housing to the light source.

16. The outdoor lighting structure of claim 8, wherein the planar portion is substantially planar and the skirt portion curves down from the planar portion.

17. The outdoor lighting structure of claim 8, wherein the housing covers the elevated portion on a top side of the housing.

18. An outdoor lighting fixture, comprising:

a housing;

a heat sink attached to the housing, the heat sink comprising a top portion and a skirt portion extending down from the top portion, wherein the heat sink is disposed below the housing and wherein the top portion comprises:

an elevated portion;

a transition portion surrounding the elevated portion, wherein the elevated portion and the transition portion define a cavity; and a planar portion surrounding the transition portion, wherein the elevated portion is elevated above the planar portion, wherein the transition portion is disposed between and is contiguous with the elevated portion and the planar portion, and wherein the planar portion is disposed between and is contiguous with the transition portion and the skirt portion, and wherein the skirt portion extends down from the planar portion;

a light source attached to the elevated portion and positioned within the cavity; and a driver positioned in the housing to provide power to the light source.

19. The outdoor lighting fixture of claim 18, wherein a lens covers the light source on an underside of the heat sink.

20. The outdoor lighting fixture of claim 19, wherein the housing covers the elevated portion and the transition portion on a top side of the housing and wherein a portion of the planar portion is outside of the housing.

* * * * *